United States Patent [19]

Marro, Jr. et al.

[11] 4,394,131

[45] Jul. 19, 1983

[54] COMBUSTION FUEL EMULSION

[75] Inventors: Joseph Marro, Jr., West Haven; Gurdon B. Wattles, North Haven, both of Conn.

[73] Assignee: Entoleter, Inc., New Haven, Conn.

[21] Appl. No.: 130,387

[22] Filed: Mar. 14, 1980

Related U.S. Application Data

[63] Continuation of Ser. No. 842,090, Oct. 14, 1977, abandoned.

[51] Int. Cl.[3] ..... C10L 1/32

[52] U.S. Cl. ..... 44/51; 252/309

[58] Field of Search ..... 44/51; 252/309

[56] References Cited

U.S. PATENT DOCUMENTS 3,876,391 4/1975 McCoy et al. ..... 252/309

*Primary Examiner*—Winston A. Douglas
*Assistant Examiner*—Y. Harris-Smith
*Attorney, Agent, or Firm*—Boris Haskell

[57] ABSTRACT

A stable combustion fuel emulsion of a petroleum fuel having a small percentage of water dispersed therein as droplets of a size of about 0.5 micron, or less, formed by high energy rotary impact milling the petroleum fuel and water together.

9 Claims, 2 Drawing Figures

COMBUSTION FUEL EMULSION

This is a continuation of application Ser. No. 842,090 filed Oct. 14, 1977, now abandoned.

SUMMARY OF INVENTION

The present invention relates to petroleum fuels, and more particularly to such fuels having small quantities of water emulsified therein. By the term "petroleum fuels" it is intended to include all grades of those products known as fuel oils, as well as refined fractions, such as gasoline and kerosene, which are used for burners in furnaces and boilers, and for piston, turbine and jet engines.

It is known in the prior art that the intermixture of a small percentage of water, such as up to about 10% by weight, with petroleum fuels can enhance the burning qualities of the fuel and thereby improve the efficiency of the fuel and reduce its noxious and undesirable emissions and by products. It has further been observed that the most effective way to incorporate the water in the petroleum fuel is by emulsification, and the present invention is directed to such water in petroleum fuel emulsion. In accordance with the prior art processes and procedures, these emulsions have been formed in-line, i.e. in the process of feed of the petroleum fuel to the combustion chamber. Further, it has been a common practice to incorporate emulsification aids, such as surfactants, in the mixture to enhance the emulsification process. Heretofore, such emulsified fuels have not been produced as stable emulsions, and those emulsified fuel can not be stored for prolonged periods of time. Therefore, the in-line procedure has necessitated the incorporation of emulsification equipment in combination with each combustion installation.

In accordance with the present invention, it has been discovered that stable emulsions of small quantities of water (i.e. up to about 15 to 20%) in petroleum fuels can be produced, even without the use of stabilizing additives. By the term "stable emulsion" is meant emulsions that can be stored for three months, or more, without any appreciable change, or separation of the dispersed phase from the continuous phase. Because of the stability of these emulsions, it is possible to produce them at a central processing station for normal distribution to consumption locations, where the emulsified fuel may then be stored and fed to burners, or the like, as required, without additional or in-line emulsification treatment.

It has been discovered that such stable emulsions are obtained when the droplet size of the water phase, i.e. the disperse phase, is substantially entirely less than about 0.5 micron. Whereas the droplet size required for stability varies somewhat with the viscosity of the petroleum fuel used, it has been observed that with a residual oil having a viscosity of 0.85 poises/sec., 0.5 micron water droplets remain in suspension for well over 3 months without any noticeable setting, while 1 micron droplets show appreciable settling in only 7 days of storage, and 10 micron droplets in only 1 hour. Although more viscous oils can obtain stability with larger droplets of water, still such significant improvements in stability are had with 0.5 micron or less droplets, that it is considered optimum for all oils. It is believed that the emulsions of the present invention are analogous to colloidal suspensions, and the droplets are retained in stable suspension by the thermal energy of the system.

Emulsions of the present invention are not easily obtained. It has been found that these emulsions can be formed by passing oil and water in the desired ratio through a high speed or high energy rotary impact mill. A rotary impact mill of the type utilized for the practice of the present invention is shown in U.S. Pat. No. 3,171,604 to K. H. Conley, et al., and the disclosure of that patent is incorporated herein by reference. In the particular mill utilized for the specific embodiments of the present specification, the rotor element had 6 concentric circular rows of impact pins, interdigitated with 5 concentric circular rows of impact pins on the stator. The outermost row of pins was located on a 35 inch diameter circle, on the rotor. The diameter of the impact pins was 0.375 inch, and the center to center spacing of adjacent pins in the same circular row was 1.6 inches, and the center to center spacing between interdigitated adjacent rows of pins was 0.625 inch. To produce an emulsion in which the water droplets were substantially all less than about 0.5 micron, the mill was operated at a rotor speed of 1650 rpm, producing a linear peripheral speed of 15,119 feet per minute. In this mill operating at the stated speed, statistically a water droplet was subject to about 102,000 impacts per second. With the foregoing mill operating at the stated parameters, the process is referred to herein as high energy milling. It is apparent that equivalent action can be accomplished by such mills designed with different interrelated parameters, and such equivalent milling is likewise embraced by the term high energy milling.

It is therefore one object of the present invention to provide a stable water and petroleum fuel emulsion.

Another object of the present invention is to provide such an emulsion for use as a combustion fuel for furnaces, boilers and engines.

And still another object of the invention is to provide such a combustion fuel which can be stored for significant periods of time without losing its emulsion state, Other objects and advantages of the present invention will become apparent to those skilled in the art from the following illustrative detailed description of the invention had in conjunction with the accompanying drawings.

DETAILED DESCRIPTION

In each of the following specific examples of the invention, the rotary impact mill as above described was utilized. Petroleum oil and water were each fed into the mill at relative rates to provide approximately 10% by weight of water in the mixture. Numerous samples of water in petroleum oil emulsions were produced, and by producing various samples at different rotor speeds for the mill, different water droplet sizes, and different size distributions were obtained. From these samples, the settling rates for various water droplet sizes were determined. The reciprocal of the settling rate is used as a measure of relative stability of the emulsions for the various water droplet sizes.

EXAMPLE I

In this example, the petroleum fuel used to form the water in oil emulsions is a residual oil, low sulfur (0.5%), viscosity at 100° F. of 400 SSU and 0.85 poises per second. The following table sets forth the settling rate (SR) in inches per month for different water droplet sizes in the emulsion, and, as a relative measure of emulsion stability for each droplet size, the reciprocal of the settling rate (1/SR).

| Water Droplet Size (microns) | Settling Rate (SR) (inches/month) | Relative Stability (1/SR) |
|---|---|---|
| 0.5 | 0.39 | 2.6 |
| 1 | 1.6 | 0.6 |
| 2 | 6.2 | 0.16 |
| 3 | 14 | 0.07 |
| 4 | 25 | 0.04 |
| 5 | 39 | 0.03 |
| 10 | 156 | 0.006 |

Figure 1:
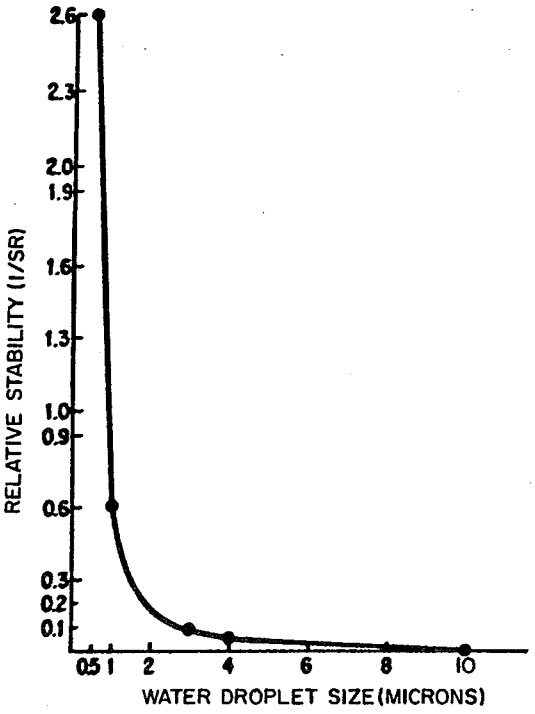
FIG. 1 is a graph plotting the emulsion stability vs. droplet size of water in oil emulsions, for residual oil, low sulfur (0.5%), viscosity at 100° F. of 400 SSU and 0.85 poises per second.

In FIG. 1, the relative stability values of the above table are plotted against water droplet size.

EXAMPLE II

In this example, the petroleum fuel used to form the water in oil emulsion is a residual oil, high sulfur (2.5%), viscosity at 100° F. of 4000 SSU and 8.0 poises per second. The following table sets forth the settling rates (SR) in inches per month for different water droplet sizes in the emulsions, and, as a relative measure of emulsion stability for each droplet size, the reciprocal of the settling rate (1/SR).

| Water Droplet Size (microns) | Settling Rate (SR) (inches/month) | Relative Stability (1/SR) |
|---|---|---|
| 0.5 | 0.0044 | 227 |
| 1 | 0.018 | 56 |
| 2 | 0.07 | 14 |
| 4 | 0.28 | 3.6 |
| 6 | 0.64 | 1.6 |
| 8 | 1.14 | 0.9 |
| 10 | 1.78 | 0.56 |

Figure 2:
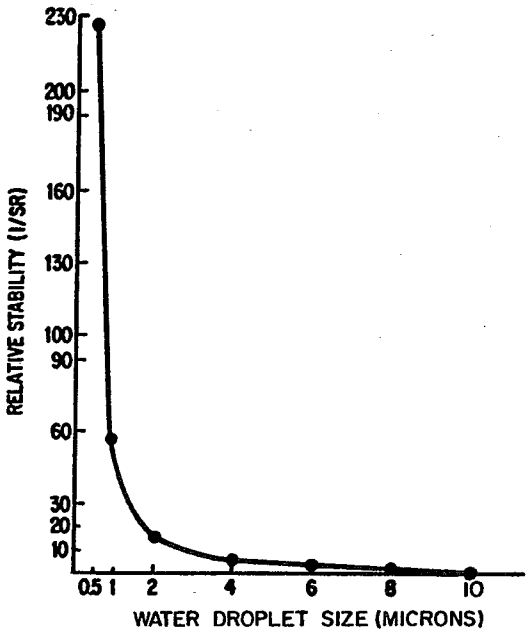
FIG. 2 is a graph corresponding to FIG. 1, but for residual oil, high sulfur (2.5%), viscosity at 100° F., of 4000 SSU and 8.0 poises per second.

In FIG. 2, the relative stability values from the foregoing table are plotted against water droplet size.

The foregoing illustrative examples of the invention demonstrate the greatly enhanced stability of a water in petroleum fuel emulsion when the water droplets are about 0.5 micron in size. To obtain the benefit of this stability, it is of course necessary that substantially all the water droplets be no greater than about 0.5 micron. When the water in oil emulsion is formed by a rotary impact mill as above described, operating at a speed of 1650 rpm, or at a peripheral linear speed of about 15,000 feet per minute, approximately 95% of the water droplets formed are less than about 0.5 micron in size. When said mill is operated at a speed of 3500 rmp, or at a peripheral linear speed of about 32,000 feet per minute, about 99.9% of the water droplets formed are less than about 0.5 micron in size.

Various modifications and variations of the invention will become apparent to those skilled in the art, and such as are embraced by the spirit and scope of the appended claims are contemplated as within the purview of the invention. For example, since the rotary impact mill is an effective and efficient pulverizer for solids, solid fuels such as coal or other carbonaceous materials can be fed into the mill with the oil and water, and the solid fuel will be pulverized and suspended in the water in oil emulsion as the latter is formed in the mill. In this manner there is produced an oil-solids-water slurry/emulsion.

What is claimed is:

1. A stable combustion fuel emulsion consisting essentially of a petroleum fuel as the continuous phase and water droplets dispersed therein, wherein said water is present in an amount less than about 20% by weight, and wherein said water droplets are substantially all of a size less than about 0.5 micron, said emulsion being free of surfactants.

2. A stable combustion fuel emulsion as set forth in claim 1, wherein the amount of said water is about 15% by weight.

3. A stable combustion fuel emulsion as set forth in claim 1, wherein the amount of water is about 10% by weight.

4. A stable combustion fuel emulsion as set forth in claim 1, wherein said petroleum fuel is a fuel oil.

5. A stable combustion fuel emulsion as set forth in claim 4, wherein said fuel oil is a residual oil.

6. A stable combustion fuel emulsion as set forth in claim 1, wherein said petroleum fuel and water are emulsified by high energy rotary impact milling.

7. A method of forming a stable combustion fuel emulsion free of surfactants, comprising dispersing a small percentage of water in a petroleum fuel by high energy rotary impact milling said petroleum fuel and water together until substantially all of the droplets of water dispersed in said petroleum fuel have a size of less than about 0.5 micron, and wherein the percentage of water in the emulsion is less than about 20% by weight.

8. A method as set forth in claim 7, wherein said petroleum fuel is a fuel oil.

9. A method as set forth in claim 8, wherein said fuel oil is a residual oil.

* * * * *